US005427548A

United States Patent [19]

Yagi et al.

[11] Patent Number: 5,427,548

[45] Date of Patent: Jun. 27, 1995

[54] TERMINAL FITTING INSERTION GUIDE STRUCTURE FOR CONNECTOR

[75] Inventors: Sakai Yagi; Hitoshi Sakai; Hitoshi Saito; Osamu Sugiyama, all of Shizuoka, Japan

[73] Assignee: Yazaki Corporation, Tokyo, Japan

[21] Appl. No.: 130,454

[22] Filed: Oct. 1, 1993

[30] Foreign Application Priority Data

Oct. 2, 1992 [JP] Japan ..... 4-068898 U

[51] Int. Cl.[6] ..... H01R 13/40

[52] U.S. Cl. ..... 439/595

[58] Field of Search ..... 439/594, 595, 752, 733.1

[56] References Cited

U.S. PATENT DOCUMENTS 4,979,912 12/1990 Shindo et al. ..... 439/595
4,979,915 12/1990 Pitts ..... 439/595 X
5,141,452 8/1992 Yoneda et al. ..... 439/595

FOREIGN PATENT DOCUMENTS 412270 1/1992 Japan .

*Primary Examiner*—Khiem Nguyen
*Attorney, Agent, or Firm*—Sughrue, Mion, Zinn, Macpeak & Seas

[57] ABSTRACT

The device attempts to facilitate the molding of a tapered guide surface without leaving sharp edges on the corner of the tapered guide surface in order to facilitate insertion of a terminal fitting into a terminal accommodating chamber of a connector housing. A support slit 5 for a terminal fitting is formed on a wall 3 of a terminal accommodating chamber 1 in a connector housing A. A tapered guide surface 6 is formed so as to be tapered toward the terminal accommodating chamber 1 on the wall 3 on both rear end sides of the support slit 5. On the tapered guide surface 6 are a tapered and chamfered surface 6*a* that is tapered toward the support slit 5 and a tapered and chamfered part 6*b* that is tapered toward the support slit 5 in the inner surface of the wall 3 so as to reach the tapered and chamfered part 6*a*.

3 Claims, 4 Drawing Sheets

TERMINAL FITTING INSERTION GUIDE STRUCTURE FOR CONNECTOR

BACKGROUND OF THE INVENTION

The device is directed to connectors for use in connecting wire harnesses for automobiles. The device attempts to improve the inserting performance of a terminal fitting to be inserted into the connector.

In FIGS. 4 to 8, reference character (a) designates a connector housing; and (b), a terminal holding attachment. Each of them is integrally formed of a synthetic resin material. The connector housing (a) interposes a gap (d) between a terminal accommodating block ($a_2$) and a male case ($a_1$), the gap (d) extending around the outer periphery of the terminal accommodating block ($a_2$) as well as in the rear half of the case ($a_1$). The terminal accommodating block ($a_2$) consists of a plurality of terminal accommodating chambers (c). The terminal accommodating block ($a_2$) is arranged so as to be partially exposed at openings (e) of the case ($a_1$). In the rear of the case ($a_1$) are temporary holding holes (f) and regular holding holes (g).

A plurality of terminal accommodating chambers (c) are juxtaposed in the terminal accommodating block ($a_2$). Each terminal accommodating chamber (c) has a cantilevered flexible holding strip (h) and a stopper (i) on the front end thereof.

The terminal holding attachment (b) is designed so that a pair of terminal bias parts (l) are erectable through hinges (k) that are arranged on the rear ends of upper and lower walls ($j_1$) of a rectangular main frame part (j). The terminal bias parts (l) are erected when they are not bound by the biasing of the hinges (k) (see FIGS. 4, 5, 6, and 7). When the terminal bias parts (l) are pulled down, they have stopper parts ($l_1$) engaged with stabilizers ($m_1$) erecting in the rear ends of terminal fittings (m).

On the front ends of side walls ($j_2$) of the main frame part (j) of the terminal holding attachment (b) are not only cantilevered flexible holding strips (n), but also temporary holding projections (o) that are arranged on the outer sides of the flexible holding strips (n). On the front surface of each terminal bias part (l) are regular holding projections (p).

When the connector is used, the terminal holding attachment (b) is temporarily coupled to the connector housing (a) with the temporary holding projections (o) being temporarily engaged with the temporary holding holes (f). Under such condition, by inserting the terminal fitting (m) into each terminal accommodating chamber (c) from the rear of the connector housing (a), a female contact ($m_2$) formed on the front of the terminal accommodating chamber (c) is fixed while positioned between the stopper (i) and a holding end ($h_1$) of the flexible holding strip (h) (FIG. 7). Since the terminal bias parts (l) are erected under this condition, there is no likelihood that the terminal holding attachment (b) will be further inserted by force unexpectedly to be regularly coupled to the connector housing.

To effect regular coupling, the terminal bias parts (l) must be pulled down against the biasing of the hinges (k) and further inserted by force directly so that the regular holding projections (p) get engaged with the regular holding holes (g) of the case ($a_1$). Under this condition, the upper and lower walls ($j_1$) of the main frame part (j) close the openings (e) of the case ($a_1$) (FIG. 8).

As shown in FIG. 9, the terminal accommodating block ($a_2$) positioned inside the case ($a_1$) of the connector housing (a) has narrowed support slits ($c_2$) on the front of the respective terminal accommodating chambers (c). Each narrowed support slit ($c_2$) has an outwardly extending opening ($c_1$) and extends contiguously from such opening ($c_1$). When the terminal fitting (m) is inserted into the terminal accommodating chamber (c), the stabilizer ($m_1$) arranged in the rear of the terminal fitting (m) is fitted into the narrow support slit ($c_2$) to stabilize the inserting position (Japanese Utility Model Unexamined Publication No. 12270/1992).

In this case, on the rear end of a wall ($c_3$) forming a support slit ($c_2$) is an arcuate guide surface (q), which is provided to ensure smooth insertion of the terminal fitting into the terminal accommodating chamber (c). As shown in FIG. 10, if a terminal fitting (m') to be inserted is female and has a stabilizer ($m_1'$) and a wide female electric contact ($m_2'$) on an end thereof, then the end may, in many cases, contact the arcuate guide surfaces (q) while deviating from the middle part of the arcuate guide surface (q), thereby not allowing the arcuate guide surface (q) to serve the guiding function effectively.

FIG. 11 shows an example in which the effect of insertion guide of the terminal fitting is improved by forming tapered guide surfaces (r) in place of the arcuate guide surface (q). In this case, sharp edges ($r_1$) are inevitably formed on both corners of the tapered guide surfaces (r) as shown in FIG. 12. Such a profile might cause defective molding due to short shot and gas during molding.

SUMMARY OF THE INVENTION

The device has been made in view of the above circumstances. Accordingly, the object of the device is to provide a perfect resin molded product without forming sharp edges at the corner of a tapered guide surface for a terminal fitting.

To achieve the above object, the device is applied to a terminal fitting insertion guide structure for a connector that includes: a support slit 5 for a terminal fitting; and a tapered guide surface 6. The support slit 5 is arranged on a wall 3 of a terminal accommodating chamber 1 in a connector housing. The tapered guide surface 6 is tapered toward the terminal accommodating chamber 1 and arranged on the wall 3 on each of both rear sides of the support slit 5. The tapered guide surface 6 has a tapered and chamfered part **6*a* and a tapered and chamfered part 6*b*. The tapered and chamfered part 6*a* is tapered toward the support slit 5, and the tapered and chamfered part 6*b* is tapered toward the support slit 5 in the inner surface of the wall 3 so as to reach the tapered and chamfered part 6*a***.

The tapered guide surface smoothly guides the insertion of the terminal fitting into the terminal accommodating chamber.

DETAILED DESCRIPTION OF THE PREFERRED EMBODIMENTS

Figure 1:
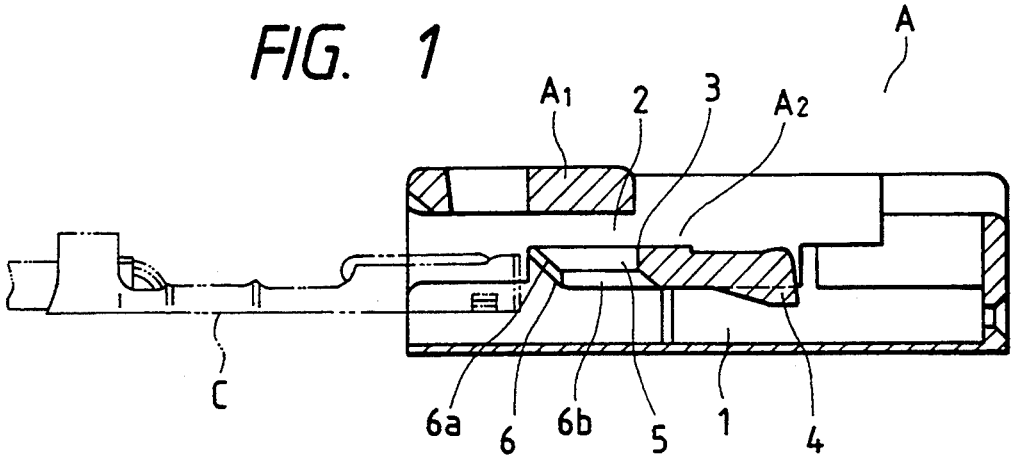
FIG. 1 is a sectional view of a connector housing of the device.
Figure 2:
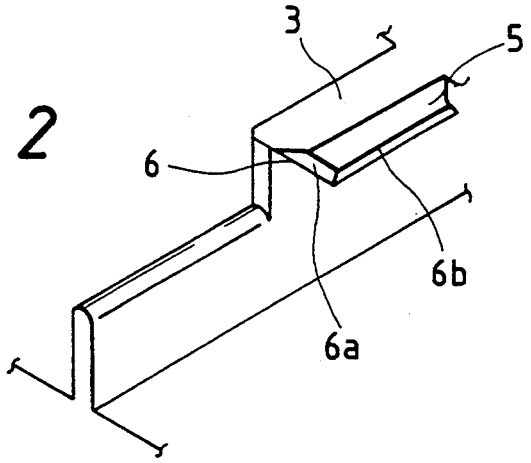
FIG. 2 is a perspective view of a main part of the same.

In FIG. 1, reference character A designates a connector housing integrally formed of a synthetic resin. A terminal accommodating block $A_2$ is formed in a male case $A_1$ while interposing a gap 2 between the outer periphery of the terminal accommodating block $A_2$ and the case $A_1$. The terminal accommodating block $A_2$ consists of a plurality of terminal accommodating chambers 1.

On an outer side wall 3 of each terminal accommodating chamber 1 are a flexible holding strip 4 for a terminal fitting C and a support slit 5. The support slit 5 extends in the rear of the wall 3. In the rear end of the wall 3 on both sides of the support slit 5 are tapered guide surfaces 6 for the terminal fitting C. Each tapered guide surface 6 is formed so as to be tapered toward the terminal accommodating chamber 1. The tapered guide surface 6 has a tapered and chamfered part 6*a* that is tapered toward the support slit 5. On the inner surface of the outer side wall 3 is a tapered and chamfered part 6*b* that is tapered also toward the support slit 5. The tapered and chamfered part 6*b* is formed so as to reach the tapered and chamfered part 6*a*. Therefore, the tapered and chamfered parts 6*a*, 6*b* contribute to not forming the above-mentioned sharp edges on both corners of the tapered guide surfaces 6.

Figure 3:
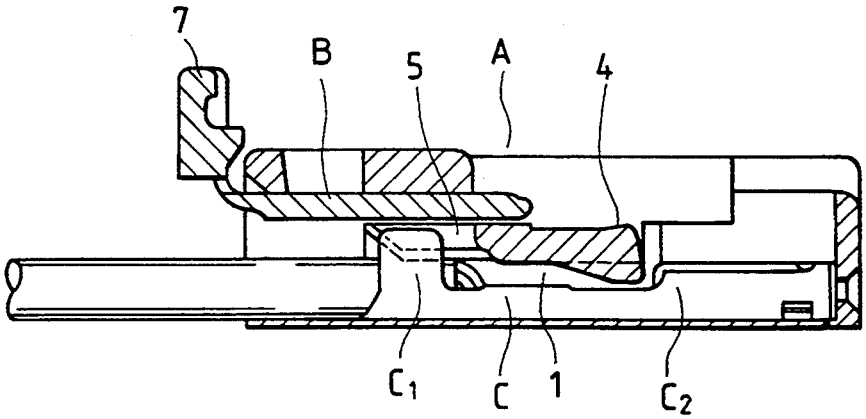
FIG. 3 is a sectional view of the connector housing with a terminal fitting and a terminal holding attachment being arranged therein.
Figure 4:
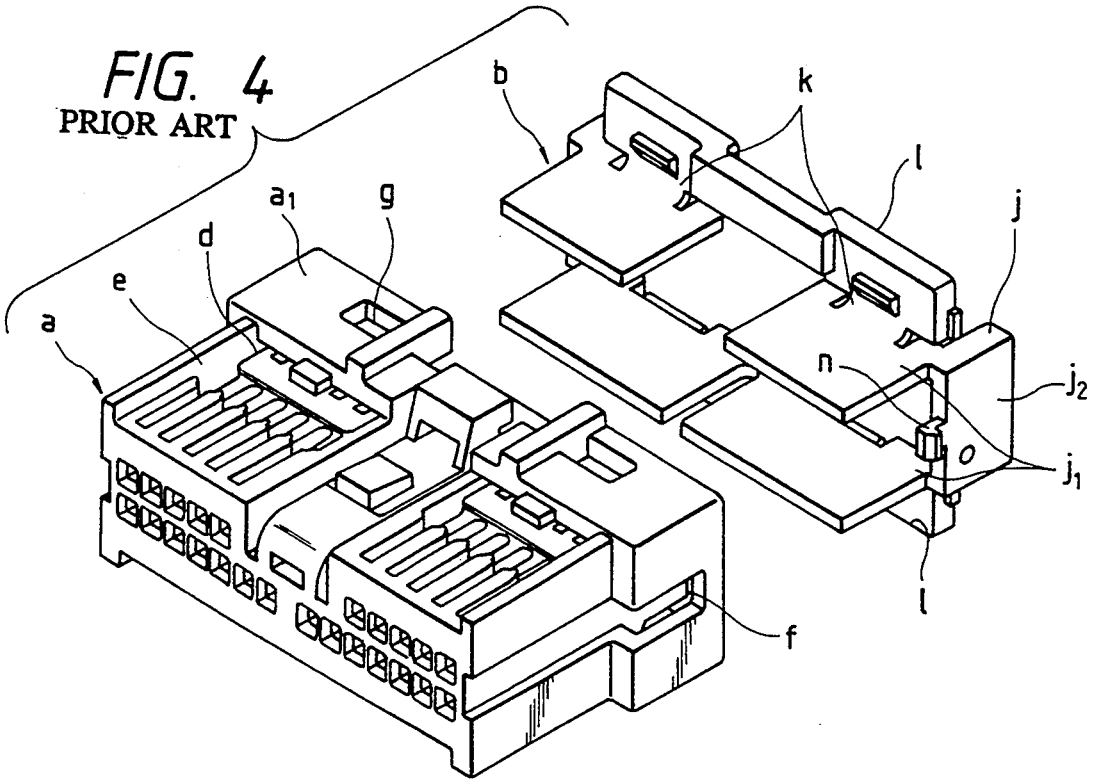
FIG. 4 PRIOR ART
FIG. 4 is a perspective view of a connector housing and a terminal holding attachment of a conventional example as viewed from top.
Figure 5:
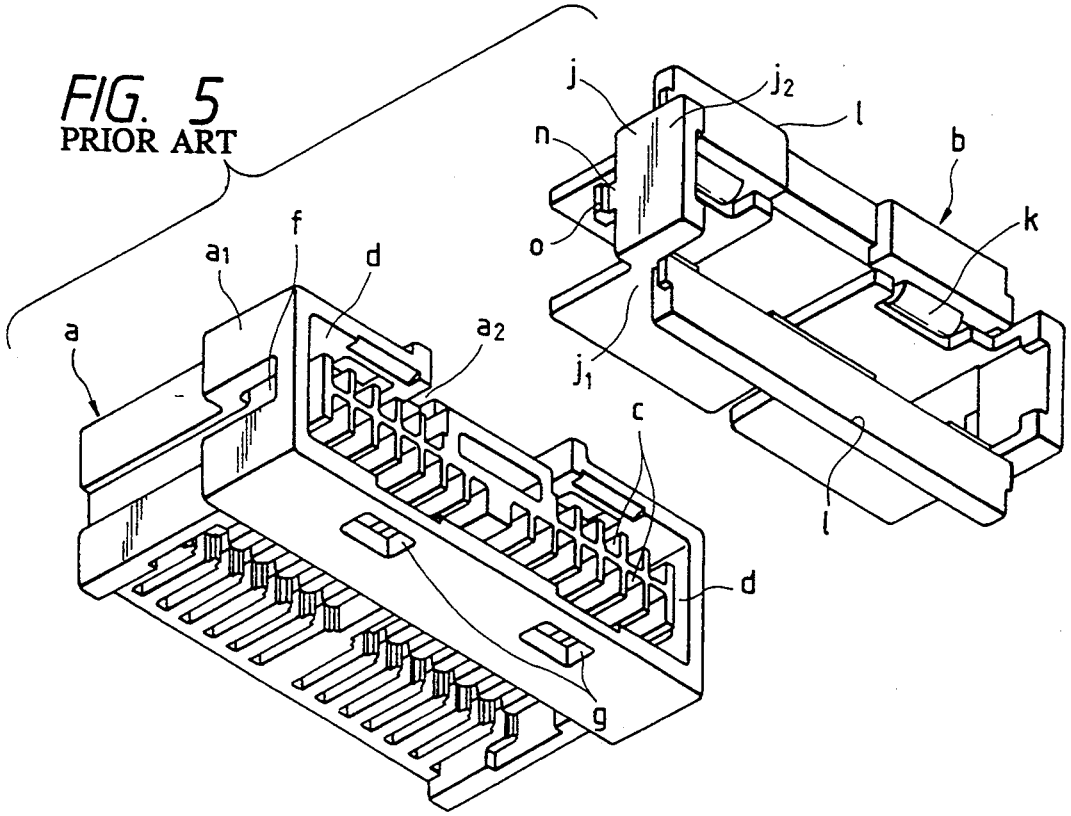
FIG. 5 PRIOR ART
FIG. 5 is a perspective view of the connector housing and the terminal holding attachment of the same as viewed from bottom.
Figure 6:
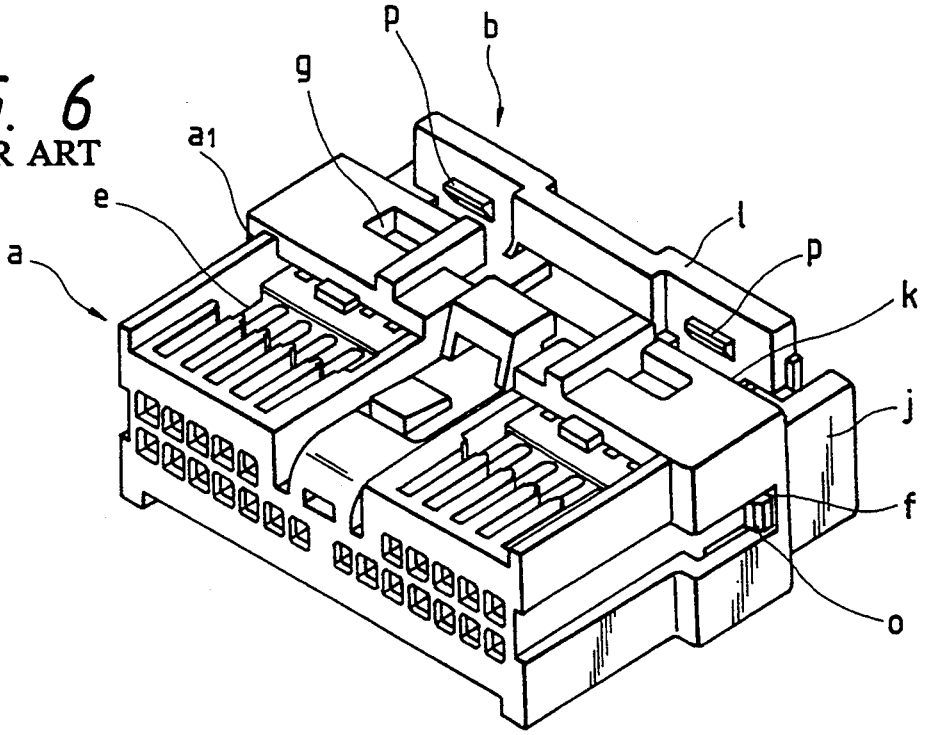
FIG. 6 PRIOR ART
FIG. 6 is a perspective view of the connector housing and the terminal holding attachment of the same being temporarily coupled with each other.
Figure 7:
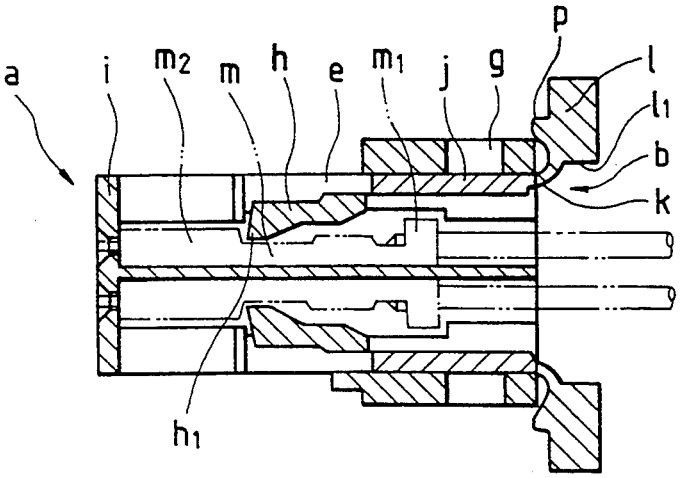
FIG. 7 PRIOR ART
FIG. 7 is a sectional view of the connector housing and the terminal holding attachment of the same being temporarily coupled with each other.
Figure 8:
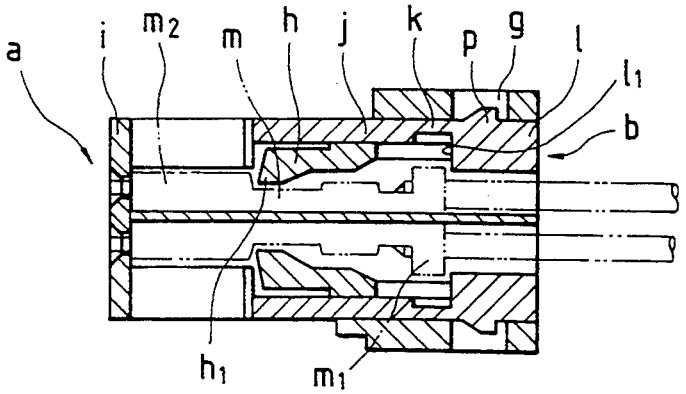
FIG. 8 PRIOR ART
FIG. 8 is a sectional view of the connector housing and the terminal holding attachment of the same being regularly coupled with each other.
Figure 9:
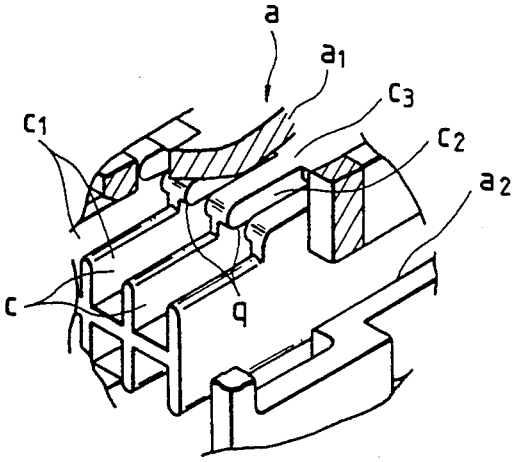
FIG. 9 PRIOR ART
FIG. 9 is a perspective view of a main part of the same.
Figure 11:
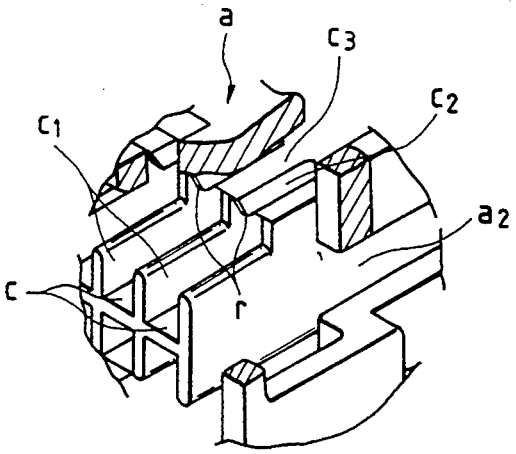
FIG. 11 PRIOR ART
FIG. 11 is a perspective view of a main part of another conventional example.
Figure 10:
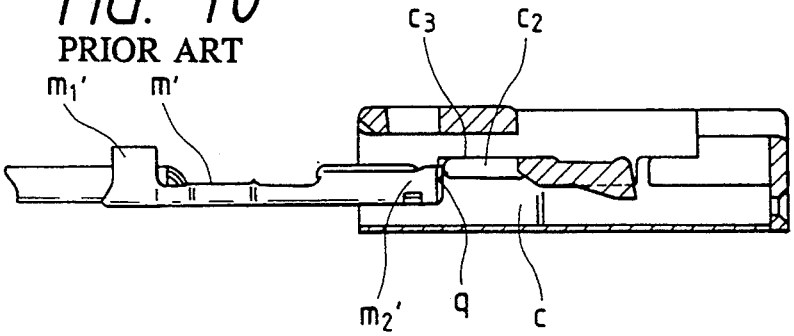
FIG. 10 PRIOR ART
FIG. 10 is a sectional view of a terminal being inserted in the same.
Figure 12:
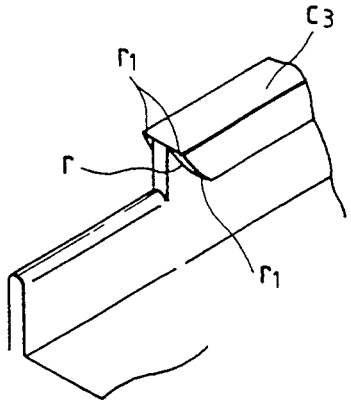
FIG. 12 PRIOR ART
FIG. 12 is an enlarged perspective view of a main part of the same.

FIG. 3 shows a state in which a stabilizer $C_1$ of the terminal fitting C is fitted into the support slit 5 by inserting the terminal fitting C into the terminal accommodating chamber 1 of the connector housing A and in which a female electric contact $C_2$ is engaged with the flexible holding strip 4. Similar to the conventional example, a terminal bias part 7 is engaged with the stabilizer $C_1$ to doubly hold the terminal fitting C by regularly coupling a terminal holding attachment B that has already been temporarily coupled.

As described above, the device is characterized as not only forming a support slit 5 for a terminal fitting on a wall 3 of a terminal accommodating chamber 1 of a connector housing and forming a tapered guide surface 6 so as to be tapered toward the terminal accommodating chamber 1 on the wall 3 that is on the rear side of the support slit 5, but also forming a tapered and chamfered part 6*a* that is tapered toward the support slit 5 on the tapered guide surface 6 and forming a tapered and chamfered part 6*b* tapered toward the support slit 5 on the inner surface of the wall 3 so as to reach the tapered and chamfered part 6*a*. As a result of the arrangement, the insertion of the terminal fitting into the terminal accommodating chamber of the connector housing is facilitated by the tapered guide surface, and no sharp edges are formed on the end parts of the tapered guide surfaces owing to the tapered and chamfered parts. This ensures perfect molding of the tapered guide surface.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A terminal fitting insertion guide structure for a connector, comprising:

a support slit for a terminal fitting, the support slit being arranged in a wall of a terminal accommodating chamber in a connector housing;

a tapered guide surface being tapered toward the terminal accommodating chamber and arranged on the wall on each of both rear sides of the support slit, the tapered guide surface having a first tapered and chamfered part and a second tapered and chamfered part, in which said first tapered and chamfered part is tapered toward the support slit and said second tapered and chamfered part is tapered toward said support slit in an inner surface of the wall so as to reach said first tapered and chamfered part, wherein said first and second tapered and chamfered parts are formed in such a manner that no sharp edges are formed on end parts of said tapered guide surfaces.

2. A terminal fitting insertion guide structure for a connector according to claim 1, in which said structure is integrally formed of a synthetic resin.

3. A connector, comprising:

a connector housing having a terminal accommodating chamber for receiving a terminal, said terminal accommodating chamber being defined by at least one wall having a support slit therein, defined by opposing guide walls, adapted to receive a portion of a terminal when the terminal is positioned in the terminal accommodating chamber, wherein each said guide walls includes a first tapered and chamfered part and a second tapered and chamfered part, said first tapered and chamfered part being tapered inwardly toward the support slit and said second tapered and chamfered part being tapered toward said support slit in an inner surface of said guide wall so as to join with said first tapered and chamfered part, wherein said first and second tapered and chamfered parts are formed in such a manner that no sharp edges are formed on an end portion thereof.

* * * * *